US008849139B2

(12) United States Patent
Makino

(10) Patent No.: US 8,849,139 B2
(45) Date of Patent: Sep. 30, 2014

(54) IMAGE FORMING APPARATUS

(71) Applicant: Canon Kabushiki Kaisha, Tokyo (JP)

(72) Inventor: Masahiro Makino, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 123 days.

(21) Appl. No.: 13/677,639

(22) Filed: Nov. 15, 2012

(65) Prior Publication Data

US 2013/0136476 A1 May 30, 2013

(30) Foreign Application Priority Data

Nov. 25, 2011 (JP) ..... 2011-258142

(51) Int. Cl.
*G03G 15/16* (2006.01)
*G03G 15/14* (2006.01)

(52) U.S. Cl.
CPC ..... *G03G 15/14* (2013.01); *G03G 2215/00594* (2013.01); *G03G 2215/0129* (2013.01); *G03G 15/167* (2013.01)
USPC ..... 399/66

(58) Field of Classification Search
USPC ..... 399/66, 101
See application file for complete search history.

(56) References Cited

U.S. PATENT DOCUMENTS

| | | | | |
|---|---|---|---|---|
| 7,636,100 | B2 | 12/2009 | Maebashi | |
| 8,259,143 | B2 | 9/2012 | Maebashi | |
| 2007/0008397 | A1 | 1/2007 | Maebashi | |
| 2009/0190950 | A1 * | 7/2009 | Ai et al. | 399/101 |
| 2010/0046993 | A1 | 2/2010 | Maebashi | |
| 2010/0322653 | A1 * | 12/2010 | Yasumoto | 399/66 |
| 2012/0170952 | A1 * | 7/2012 | Ai | 399/101 |
| 2013/0101321 | A1 * | 4/2013 | Suzuki | 399/302 |

FOREIGN PATENT DOCUMENTS

| | | | |
|---|---|---|---|
| JP | 2005-215047 | A | 8/2005 |
| JP | 2007-47474 | A | 2/2007 |
| JP | 2008-152307 | A | 7/2008 |
| JP | 2009-31511 | A | 2/2009 |
| JP | 2009-80419 | A | 4/2009 |

* cited by examiner

*Primary Examiner* — Walter L Lindsay, Jr.
*Assistant Examiner* — Rodney Bonnette
(74) *Attorney, Agent, or Firm* — Fitzpatrick, Cella, Harper & Scinto

(57) ABSTRACT

In a case of executing a marginless print mode on an image forming apparatus, a control portion controls a position changing portion configured to change a position of a toner image and a position of a recording material for image formation. Then, the position changing portion is controlled to move the position of the toner image and the position of the recording material for subsequent image formation by the same change amount toward a smaller of image data amounts corresponding to both end portions of the recording material of the toner image formed before the subsequent image formation.

6 Claims, 8 Drawing Sheets

IMAGE FORMING APPARATUS

BACKGROUND OF THE INVENTION

1. Field of the Invention

The present invention relates to an image forming apparatus such as a printer or a copying machine which is operable in a marginless print mode of printing on a whole surface of a recording material without providing a margin in the recording material.

2. Description of the Related Art

Image forming apparatuses such as printers and copying machines are required to perform marginless print (borderless print) for placing image information on a whole surface of a recording material without providing a margin in the recording material. This is not only because values such as quality of an output matter can be improved but also because there is large cost merit owing to reduction in processing of removing the margin in an after-print processing to meet a user's demand from the standpoint of, for example, a producer of the output matter.

In electrophotographic systems, one of the major factors hindering the realization of the marginless print is a marking back caused by expanded toner. The marking back represents a phenomenon in which, in a case of continuous print, unnecessary toner expanded from a preceding recording material and adhering to a transfer roller is not cleaned up satisfactorily within a short time before a succeeding recording material is conveyed to a transfer portion, so that the unnecessary toner adheres to a back side surface of the succeeding recording material.

Japanese Patent Application Laid-Open No. 2005-215047 discloses an image forming apparatus configured to prevent such a marking back. The image forming apparatus is configured to prevent the marking back from occurring on a succeeding recording material by adjusting a start position of writing of a latent image performed by a writing unit based on a detection result from a deviation detecting unit configured to detect a deviation of the recording material and, after the adjustment, controlling the writing unit to start writing the latent image to a plurality of photosensitive drums.

Further, Japanese Patent Application Laid-Open No. 2007-47474 discloses another image forming apparatus configured to prevent the above-mentioned marking back. In the image forming apparatus, a transfer step is executed when a region of a surface of a conveyor belt configured to convey the recording material to which unnecessary toner due to a marginless image transfer does not adhere is larger than a region thereof which is necessary for an image to be transferred subsequently. When smaller, a cleaning step of cleaning the conveyor belt is executed, to thereby prevent the marking back.

However, in the above-mentioned image forming apparatus disclosed in Japanese Patent Application Laid-Open No. 2005-215047, the marking back can be reduced, but it is difficult to maintain high positional accuracy of the recording material being conveyed even if positional accuracy of the image by the writing unit is improved. It is difficult to constantly maintain a fixed size of the recording material, and hence there is a fear that a problem of generating a margin may occur occasionally.

Further, in the image forming apparatus disclosed in Japanese Patent Application Laid-Open No. 2007-47474, the marking back can be reduced, but it is necessary to provide an interval before the succeeding recording material is conveyed if the region to which the expanded toner adheres is large. As a result, there is a fear that a problem of a considerable decrease in the productivity may occur.

SUMMARY OF THE INVENTION

The present invention provides an image forming apparatus which performs a continuous print in a marginless print mode without causing an occurrence of a marking back or a decrease in productivity ascribable to toner expanded from a recording material.

According to an exemplary embodiment of the present invention, there is provided an image forming apparatus, including: a movable image bearing member; a toner image forming portion configured to form a toner image on the image bearing member according to image data; a transfer member configured to form a transfer portion by being pressed against the image bearing member, and transfer the toner image on the image bearing member to a recording material at the transfer portion; a position changing portion configured to change a position of the toner image to be formed on the image bearing member in a width direction orthogonal to a moving direction of the image bearing member and a position in the width direction of the recording material to be conveyed to the transfer portion; a cleaning member configured to clean toner adhering to the transfer member; an execution portion configured to execute a marginless print mode of forming the toner image on the recording material without providing a margin by forming the toner image extending from a first region of the image bearing member corresponding to a position outside one end portion of the recording material in the width direction to a second region of the image bearing member corresponding to a position outside the other end portion of the recording material in the width direction; and a control portion configured to control the position changing portion, in a case where the execution portion continuously executes the marginless print mode, to change both the position of the toner image and the position of the recording material in the width direction to be used for performing subsequent image formation toward the first region, an integrated value of an image data amount in the first region being smaller than an integrated value of an image data amount in the second region with respect to the toner image obtained in image formation before the subsequent image formation, so that a change amount of the position of the toner image becomes the same as a change amount of the position of the recording material.

According to the exemplary embodiment of the present invention, at the execution of the marginless print mode, it is possible to perform the printing while displacing the recording material toward a side on which the data amount is smaller, and hence it is possible to perform the continuous print without causing the occurrence of the marking back or the decrease in productivity.

Further features of the present invention will become apparent from the following description of exemplary embodiments with reference to the attached drawings.

DESCRIPTION OF THE EMBODIMENTS

In the following, embodiments of the present invention will be described in detail with reference to the accompanying drawings.

(First Embodiment)

Figure 1:
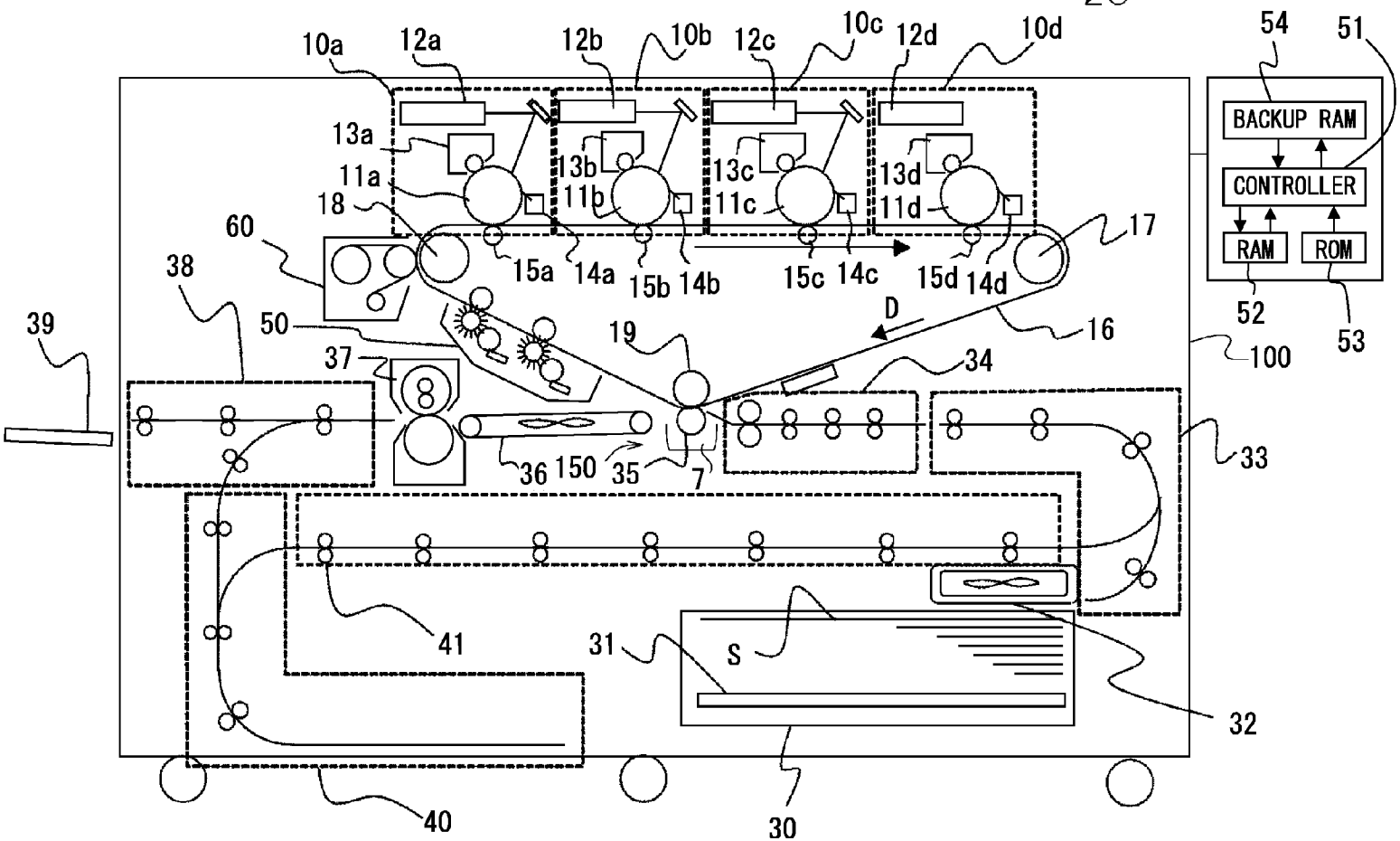
FIG. 1 is a schematic structural diagram illustrating an example of an image forming apparatus according to an embodiment of the present invention.

An image forming apparatus according to a first embodiment of the present invention will be described with reference to the accompanying drawings. Note that, FIG. 1 is a diagram illustrating a schematic structure of an image forming apparatus according to the embodiment.

An image forming apparatus 1 is configured to execute a marginless print mode (borderless print mode) of performing marginless print (borderless print) for forming a toner image without providing a margin (border) in a width direction orthogonal to a recording material conveying direction of a recording material S.

The image forming apparatus 1 is a color printer using an electrophotographic process. As illustrated in FIG. 1, the image forming apparatus 1 has an image forming apparatus main body (hereinafter referred to as "apparatus main body") 100 provided with a plurality of image forming portions 10*a*, 10*b*, 10*c*, and 10*d* which are disposed side-by-side. The image forming portions 10*a* to 10*d* have a common structure as a station configured to form a toner image on a photosensitive member, and respectively form images in yellow, magenta, cyan, and black.

Photosensitive drums 11*a*, 11*b*, 11*c*, and 11*d* are each supported about a center thereof and rotationally driven by a drive unit (not shown). A surface of each of the photosensitive drums 11*a* to 11*d* is given a uniform amount of charge by a charging unit (not shown), and is then scanned and exposed with a laser beam modulated according to a recording image signal by each of laser scanner units 12*a*, 12*b*, 12*c*, and 12*d*, so that an electrostatic latent image is formed on the surface of each of the photosensitive drums 11*a* to 11*d*.

In addition, the electrostatic latent images are visualized as toner images by respective developing units 13*a*, 13*b*, 13*c*, and 13*d* containing developers (hereinafter referred to as "toners") of the four colors of yellow, magenta, cyan, and black, respectively. Primary transfer rollers 15*a*, 15*b*, 15*c*, and 15*d* are arranged respectively in positions opposed to the photosensitive drums 11*a* to 11*d* across an intermediate transfer belt 16 as an image bearing member configured to bear the toner images.

The intermediate transfer belt 16, which is formed of an endless belt, is passed around a drive roller 17, a secondary transfer opposing roller 19, and a tension roller 18, and is rotationally driven in the direction indicated by the arrow D by the drive roller 17. The toner images on the photosensitive drums 11*a* to 11*d* are biased by the primary transfer rollers 15*a* to 15*d* and primarily transferred onto the intermediate transfer belt 16 (toner image forming portion).

Drum cleaning devices 14*a*, 14*b*, 14*c*, and 14*d* are arranged downstream of primary transfer positions of the photosensitive drums 11*a* to 11*d*, respectively. The drum cleaning devices 14*a* to 14*d* scrape off the toner with cleaning blades to clean the surfaces of the photosensitive drums 11*a* to 11*d*, respectively. By the above-mentioned process, the images formed of the toner of the respective colors are sequentially transferred onto the intermediate transfer belt 16.

In a lower part of an inside of the image forming apparatus 1, a feeder unit 30 which contains a plurality of recording materials (sheets) S is disposed. The recording materials S contained in the feeder unit 30 are kept at a predetermined feeding position by a lifter plate 31, and fed sheet by sheet by a separating and feeding unit 32. The fed recording material S is conveyed by a feeding and conveying unit 33, registered by the registration unit 34, and then conveyed to a secondary transfer portion 150 in synchronization with the toner images on the intermediate transfer belt 16. A part of the registration unit 34 and the feeding and conveying unit 33 constitutes a conveying unit configured to convey the recording material S.

Figure 2:
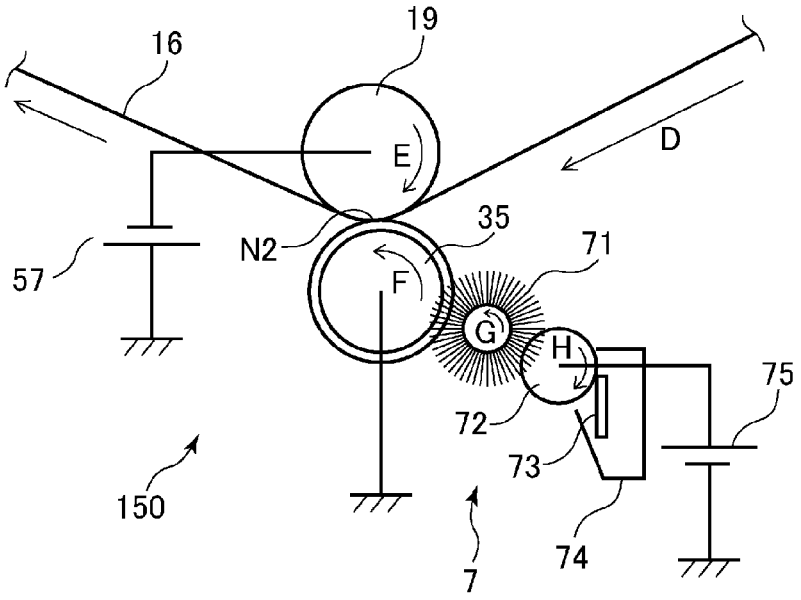
FIG. 2 is a structural diagram schematically illustrating a secondary transfer cleaning device in the image forming apparatus of FIG. 1.

As illustrated in FIG. 2, the secondary transfer portion 150 has a secondary transfer nip N2 between the intermediate transfer belt 16 and a secondary transfer roller 35. The secondary transfer roller 35 performs the secondary transfer of the toner images onto the recording material S in abutment with the intermediate transfer belt 16 internally supported by the secondary transfer opposing roller 19 connected to a ground potential 57.

In the secondary transfer portion 150, a bias is applied to the secondary transfer roller 35 so that the toner images on the intermediate transfer belt 16 are transferred onto the recording material S. In other words, the toner images superimposed on top of each other on the intermediate transfer belt 16 by the primary transfer are collectively secondarily transferred onto the recording material S by a bias power supply (not shown) applying a bias having a polarity reverse to a polarity of the toner to the secondary transfer roller 35. In addition, the recording material S is conveyed to a fixing unit 37 by a before-toner-fixation conveyor unit 36, and the toner images are fixed to the recording material S in the fixing unit 37.

The toner and an external additive remaining on the intermediate transfer belt 16 after the secondary transfer are removed by a first cleaning device 50 and a second cleaning device 60 (see FIG. 1). In a case of a simple, one-sided print step, the recording material S is conveyed by a delivery unit 38 illustrated in FIG. 1, and delivered to a delivery tray 39. On the other hand, in a case of a duplex print step, the recording material S is conveyed to a sheet surface reverse unit 40 by which a front surface and a back surface of the recording material S are reversed. Then the recording material S is conveyed again to the registration unit 34 through the feeding and conveying unit 33 and the duplex conveyor unit 41. Then an image is transferred onto and fixed to the back surface of the recording material S and the recording material S is delivered to the delivery tray 39.

Further, the apparatus main body 100 includes a controller portion (control portion) 51 configured to centrally control a whole main body. The controller portion 51 is connected to a RAM 52 used as a working memory, a ROM 53 configured to store a program executed by the controller portion 51 and various kinds of data, and a backup RAM 54 configured to back up obtained data.

Next, a secondary transfer cleaning device 7 configured to clean the secondary transfer portion 150 having the secondary transfer nip N2 between the intermediate transfer belt 16 and the secondary transfer roller 35 will be described in detail with reference to FIG. 2.

The secondary transfer portion 150 constitutes a transfer unit configured to transfer the toner image borne by the intermediate transfer belt (image bearing member) 16 onto the recording material S conveyed by the conveying unit using partial components of the registration unit 34 and the feeding and conveying unit 33. Further, the secondary transfer cleaning device 7 constitutes a cleaning unit configured to collect unnecessary toner adhering to the secondary transfer portion (transfer unit) 150 at a time of transfer.

As illustrated in FIG. 2, the secondary transfer cleaning device 7 is disposed so as to clean the secondary transfer roller 35 on an upstream side of the secondary transfer nip N2. The secondary transfer cleaning device 7 includes a fur brush 71 serving as a first cleaning member, a metal roller 72 serving as a second cleaning member, a cleaning blade 73 serving as a removal unit, and a waste toner container 74. Note that, FIG. 2 illustrates a rotational direction E of the secondary transfer opposing roller 19, a rotational direction F of the secondary transfer roller 35, a rotational direction G of the fur brush 71, and a rotational direction H of the metal roller 72.

While the fur brush 71 is rotated in the rotational direction G, the fur brush 71 electrostatically attracts and collects the toner on the secondary transfer roller 35 which is rotated in the rotational direction F. While the metal roller 72 is rotated in the rotational direction H, the metal roller 72 is in slide contact with the fur brush 71 to apply a cleaning voltage to the fur brush 71 and the metal roller 72 also electrostatically attracts and collects the toner from the fur brush 71. The cleaning blade 73, which is disposed in abutment with the metal roller 72, scrapes off the toner on the metal roller 72 and collects the toner in the waste toner container 74.

Further, the secondary transfer cleaning device 7 includes a cleaning voltage power supply 75 serving as a power supply unit configured to output the cleaning voltage. The cleaning voltage power supply 75 is connected to the metal roller 72, and the cleaning voltage output from the cleaning voltage power supply 75 is applied to the fur brush 71 via the metal roller 72. Note that, it is normally preferred that a member formed of such as aluminum or SUS which is superior in electrical conductivity be used as the metal roller 72.

In the embodiment, the secondary transfer roller 35, which is grounded and conductive (high resistance), and the metal roller 72 are electrically connected to each other via the fur brush 71 formed of a conductive material. Accordingly, when the cleaning voltage is applied to the metal roller 72 to cause a current to flow between the metal roller 72 and the secondary transfer roller 35, a potential difference caused by a resistive divider occurs between the fur brush 71 and the metal roller 72.

The toner electrostatically attracted to the fur brush 71 from the secondary transfer roller 35 is, by the potential difference attraction, sequentially transferred from the fur brush 71 onto the metal roller 72. The toner transferred onto the metal roller 72 is removed by the cleaning blade 73 abutted with the metal roller 72 and drops into the waste toner container 74 so as to be collected by the waste toner container 74. This prevents the toner from excessively accumulating in the fur brush 71.

It is preferred that, from the viewpoint of space, the fur brush 71 have an outer diameter of 10 mm to 30 mm in a state of not making inroads in the secondary transfer roller 35. In the first embodiment, for example, in the state of not making inroads in the secondary transfer roller 35, the fur brush 71 can be set to have an outer diameter of 18 mm and a radius of 9 mm. Further, the fur brush (bristle brush) 71 can be set to have a bristle length of 4 mm, an inroad amount of 1.0 mm with respect to the secondary transfer roller 35, and an inroad amount of 1.5 mm with respect to the metal roller 72.

Further, the bristle of the fur brush 71 can be set to have a bristle implant density of 120 kF/inch$^2$, and the fur brush 71 can be set to have an electric resistance value of $3\times10^5$ Ω/cm. Further, a circumferential speed rate of the metal roller 72 can be set to "1.0" (same speed) in the same direction as a circumferential surface moving direction of the fur brush 71 at a contact portion between the metal roller 72 and the fur brush 71.

Figure 3:
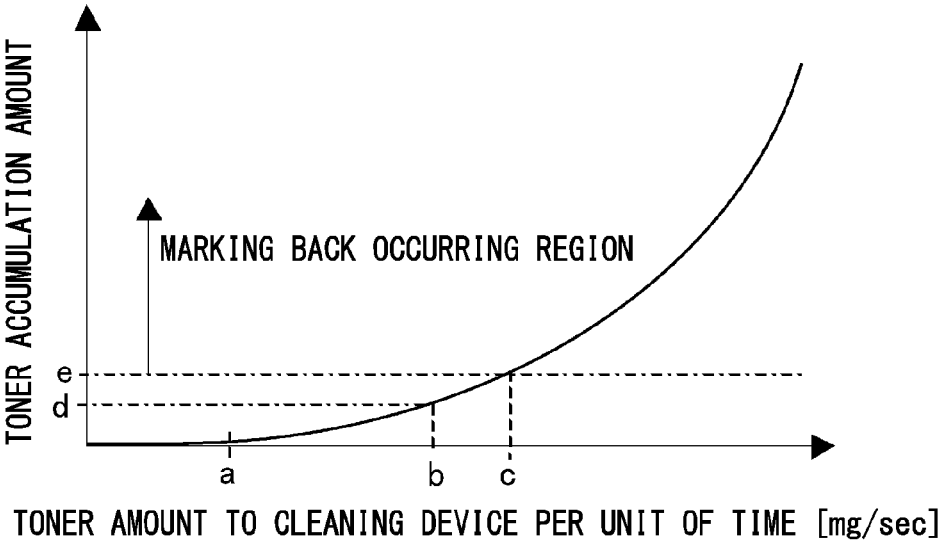
FIG. 3 is a graph schematically showing a correlation between a toner amount transferred to the secondary transfer cleaning device and a toner accumulation amount in a fur brush.

Next, cleaning performance of the secondary transfer roller 35 will be described in detail with reference to FIG. 3. FIG. 3 is a graph schematically showing a relationship between a toner amount transferred to the secondary transfer cleaning device 7 per unit of time [mg/sec] and a toner accumulation amount in the fur brush 71.

If the toner amount transferred to the secondary transfer cleaning device 7 per unit of time exceeds a certain fixed amount, a balance between the toner amount collected by the fur brush 71 and the toner amount which can be electrostatically transferred from the fur brush 71 to the metal roller 72 is lost. As a result, the toner amount accumulated on the fur brush 71 becomes large, which leads to a failure of cleaning the toner on the secondary transfer roller 35, and causes a marking back to occur. In other words, when the toner amount becomes larger than "c" in FIG. 3, the toner accumulation amount exceeds "e" to reach a marking back occurring region. Accordingly, "c" [mg/sec] can be assumed as a threshold value for an occurrence of the marking back.

The cleaning performance can be further improved by, for example, increasing the inroad amount of the fur brush 71 with respect to the secondary transfer roller 35 or raising a CLN current setting. However, according to the former, it is conceivable that life is shortened by deterioration of the cleaning performance due to flattened bristles of the brush caused by a long-term use, while according to the latter, it is conceivable that a required voltage becomes higher due to a rise in resistance of the brush caused by a long-term use, which is hard to be handled in terms of cost.

In a case of outputting an image with a margin, the toner which adheres to the secondary transfer roller 35 and in turn reaches the secondary transfer cleaning device 7 includes fogging toner which is developed due to the deterioration of the toner in addition to toner developed according to an image signal. Furthermore, there is a patch toner image periodically formed between a sheet and a sheet in order to maintain tone reproduction of the respective colors or to adjust the color registration. A fogging amount and a frequency of forming the patch toner image are adjusted to keep the toner amount equal to or smaller than "a" [mg/sec] in FIG. 3 so as to minimize the toner amount to be accumulated inside the fur brush 71.

On the other hand, in a case of outputting a marginless image, the toner expanded from a recording material adheres to the secondary transfer roller 35. In that case, it is natural that more toner reaches the secondary transfer cleaning device 7 than in the case of outputting an image with a margin. Assuming that the recording material always passes through the same conveying position, the toner always arrives at the same place on the secondary transfer cleaning device 7, and the toner amounts in positions corresponding to both end portions of the recording material exceeds "c" [mg/sec], which causes the marking back to occur.

Therefore, with this structure, in a case where the marginless print mode is selected, the controller portion 51 calculates an expanded toner amount from image information, and based on a result thereof, controls the respective components to displace an image position and the conveying position of the recording material in the same direction by the same amount. By this control, without changing the image on the recording material, it is possible to prevent the toner from locally concentrating on the fur brush 71 serving as the cleaning member and to effectively suppress the occurrence of the marking back.

The controller portion 51 constitutes a control unit according to the present invention. As described later, the controller portion 51 controls a moving mechanism (moving unit) 80 and the image forming portions (toner image forming unit) 10*a* to 10*d* in a case where continuous print is performed at the execution of the marginless print mode. The controller portion 51 thus performs the control so as to cause the transfer position of the recording material S with respect to the secondary transfer portion (transfer unit) 150 and the formation positions in which the image forming portions 10*a* to 10*d* form the toner images to move toward the smaller of image data amounts corresponding to both end portions of the recording material S in the above-mentioned width direction. This movement is performed within a range equal to or smaller than a recording material size in the width direction orthogonal to the recording material conveying direction.

Figure 5:
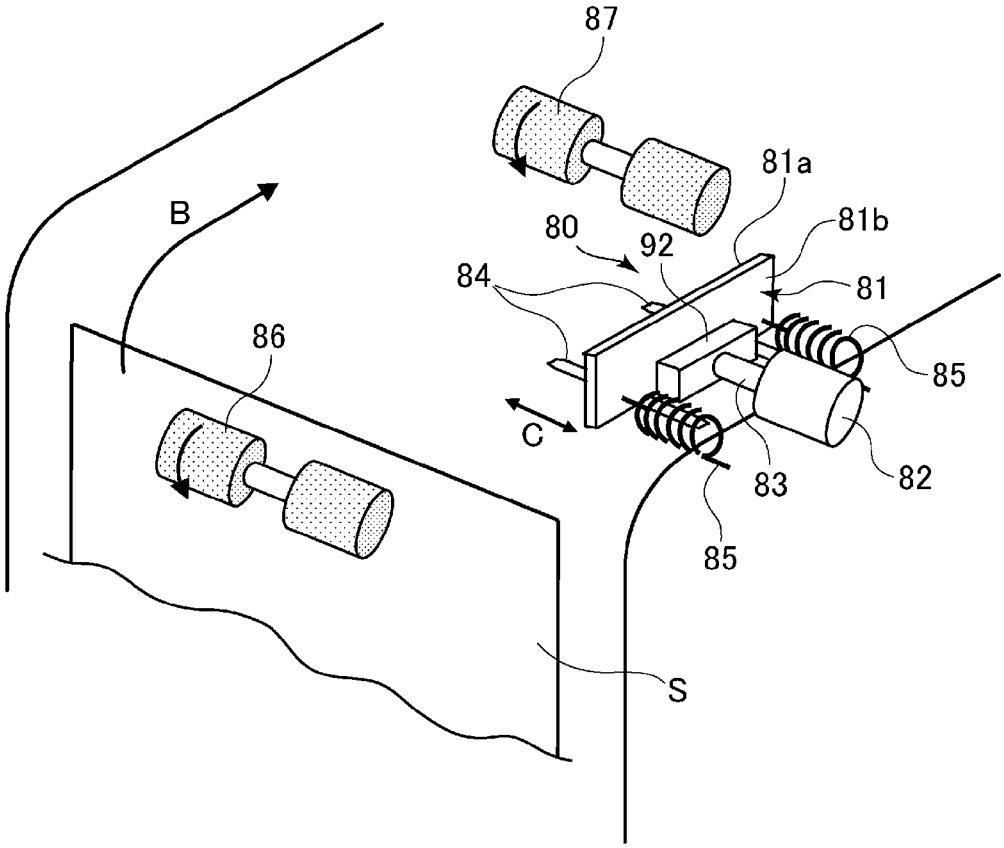
FIG. 5 is a perspective view schematically illustrating a moving mechanism in a recording material conveying path.

Next, positional adjustment of the recording material S will be described in detail with reference to FIG. 5. Note that, FIG. 5 is a perspective view schematically illustrating a moving mechanism in a recording material conveying path. FIG. 5 illustrates a state in which the feeding and conveying unit 33 and the registration unit 34 of FIG. 1 are viewed from the diagonally backward right of FIG. 1, and hence a position regulation plate 81 is located on a rear side of the feeding and conveying unit 33 and the registration unit 34 in FIG. 1.

The moving mechanism 80 including the position regulation plate 81 is disposed in, for example, the positions of the feeding and conveying unit 33 and the registration unit 34 (see FIG. 1) in the recording material conveying path from the feeder unit 30 to the secondary transfer roller 35. The moving mechanism 80 constitutes the moving unit configured to move the recording material so as to change the position of the recording material in the width direction intersecting (orthogonal to) the recording material conveying direction of the recording material S conveyed by the conveying unit (33 and 34) with respect to the secondary transfer portion (transfer unit) 150.

In this case, the recording material S conveyed by the conveying rollers 86 and 87 in the direction indicated by the arrow B of FIG. 5 is conveyed by the conveying rollers 86 and 87 by one side reference by which the recording material S abuts against the position regulation plate 81. For this reason, in an abutment operation of the position regulation plate 81 in the directions indicated by the double-headed arrow C in FIG. 5, when the position regulation plate 81 is protruded leftward in the direction indicated by the arrow C in FIG. 5, the position regulation plate 81 moves the recording material S abutted therewith toward the left of FIG. 5 (front side of FIG. 1), and when the position regulation plate 81 is retracted rightward in the direction indicated by the arrow C in FIG. 5, the position regulation plate 81 moves the recording material S abutted therewith toward the right of FIG. 5 (rear side of FIG. 1). The conveying rollers 86 and 87 can be appropriately formed of rollers disposed inside the feeding and conveying unit 33 and the registration unit 34.

In other words, in the recording material conveying path, the conveying rollers 86 and 87 exert a load on the recording material S, which has been conveyed from the feeder unit 30 via the conveying rollers 86 and 87, so that the recording material S is brought closer to the position regulation plate 81 to abut against the position regulation plate 81. An actuator 82 such as a stepping motor, which is fixed to and supported by the apparatus main body 100, and tension springs 85 are disposed on a back surface 81*b* of the position regulation plate 81 opposite to a recording material contact surface 81*a* thereof. The tension springs 85 have their respective one ends fixed to the position regulation plate 81, which has a long rectangular shape in the recording material conveying direction, on an upstream side and a downstream side thereof.

The tension springs 85 have the one ends fixed to the back surface 81*b* of the position regulation plate 81 and the other ends fixed to the apparatus main body 100, to thereby bias the position regulation plate 81 toward an actuator 82. An abutment member 92 is mounted between the tension springs 85 on the back surface 81*b*. The abutment member 92 is connected to a rod 83 coaxially connected to a rotary shaft of the actuator 82.

In a case where the stepping motor is used as the actuator 82, a moving amount of the position regulation plate 81 can be set by the number of drive pulses output to the stepping motor. Further, the rail members 84 are disposed on the upstream side and the downstream side of a lower part of the position regulation plate 81, respectively. The rail members 84 each extend in a direction (indicated by the arrow C) perpendicular to the conveying direction (indicated by the arrow B) of the recording material S and guide the position regulation plate 81 along the perpendicular direction C. With this construction, the rotation of the actuator 82 driven in a forward/reverse direction is transmitted to the position regulation plate 81 via the rod 83 and the abutment member 92, to protrude and retract the position regulation plate 81 in the perpendicular direction C.

The actuator 82 may comprise a stepping motor. The stepping motor used in the actuator 82 may rotate by 7.5° per a drive pulse and may move the rod 83 by a moving amount of 0.7 mm in the perpendicular direction C at every rotation of 360°. In this case, it is possible to perform position control of the position regulation plate 81 with a resolution of 1 pulse=14.5 μm.

Next, a control circuit configured to control a position of the position regulation plate 81 according to the embodiment will be described with reference to FIG. 6.

Figure 6:
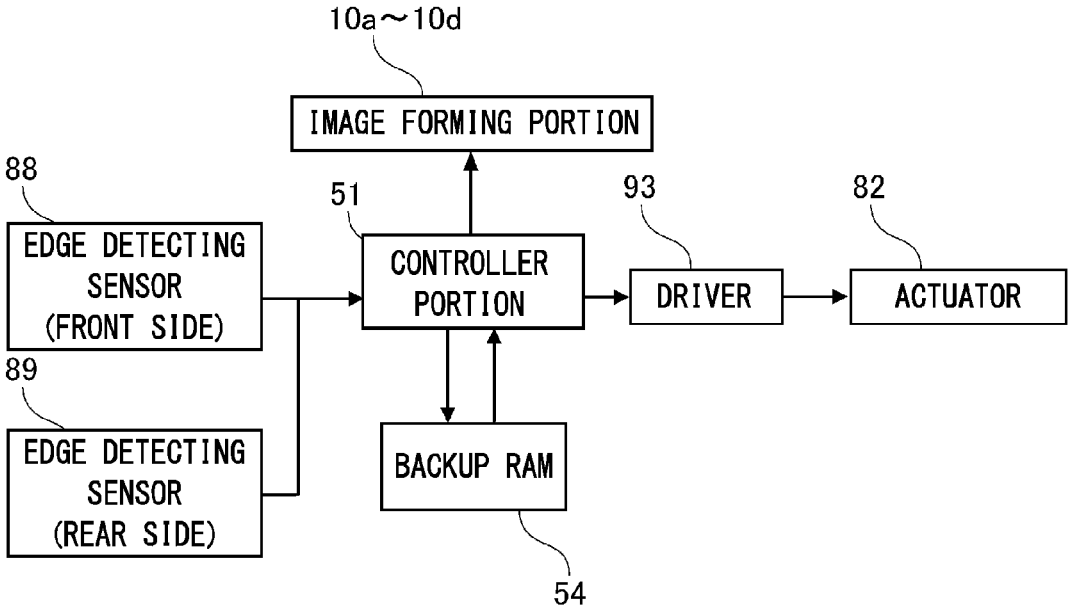
FIG. 6 is a block diagram of a control circuit configured to perform position control of a position regulation plate according to a first embodiment of the present invention.

That is, as illustrated in FIG. 6, the backup RAM 54 configured to input and output data is connected to the controller portion 51 provided in the apparatus main body 100. The controller portion 51 includes input ports to which at least edge detecting sensors 88 and 89 disposed in the recording material conveying path and configured to sense edges of the recording material S are connected. The edge detecting sensor 88 senses the edge of the recording material S on the side (front side of FIG. 1) opposite to the position regulation plate 81 in FIG. 5, and the edge detecting sensor 89 senses the edge of the recording material S on the side (rear side of FIG. 1) of the position regulation plate 81 in FIG. 5. Further, the controller portion 51 includes output ports to which at least the image forming portions 10*a* to 10*d* serving as the toner image forming unit and a driver 93 configured to transmit a drive signal to the actuator 82 are connected.

Figure 8:
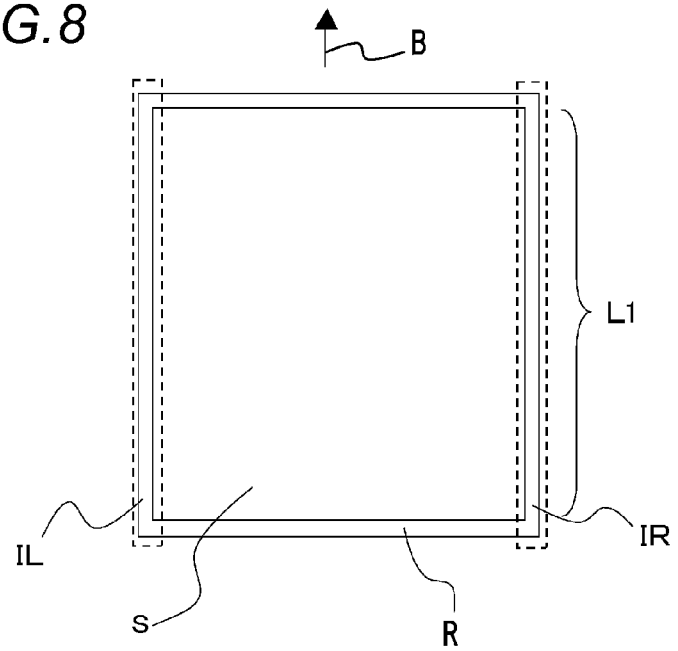
FIG. 8 is a diagram schematically illustrating a relationship between a recording material and an image region according to the first embodiment.
Figure 7:
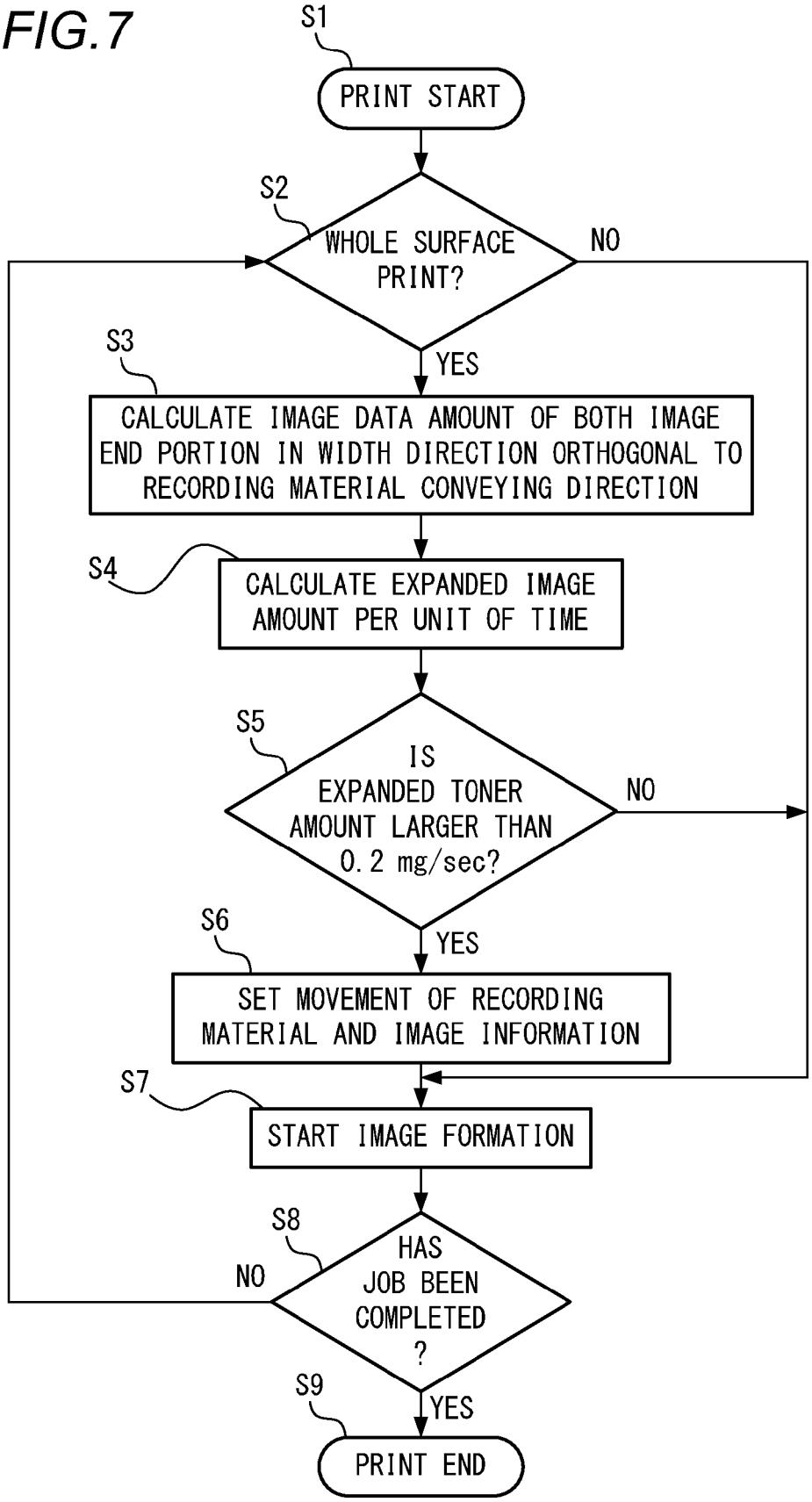
FIG. 7 is a flowchart of illustrating an operation at a time of printing according to the first embodiment.

Next, a flow of control performed in a print operation will be described with reference to a flowchart of FIG. 7 and FIG. 8. FIG. 7 is a flowchart of illustrating an operation at a time of printing according to the embodiment. FIG. 8 is a schematic diagram illustrating a relationship between the recording material S and an image region R according to the embodiment.

That is, when print information is sent to start printing (S1), the controller portion 51 (see FIG. 1 and FIG. 6) first determines whether the print is a marginless print (whole surface print) or a print with a margin (S2). In the step S2, when the print with a margin is determined, it is recognized that position displacement control is unnecessary, and an image formation is started (S7).

On the other hand, when the marginless print is determined in the step S2, the controller portion 51 subsequently calculates the image data amounts of both end portions of an image in the width direction orthogonal to a recording material conveying direction B (S3).

When the marginless print is continuously performed for different images, the image data amount is calculated based on a cumulative value of the amount of the image data of images which have already been transferred.

Further, when the marginless print is continuously performed for the same image, comparison of the image data amounts is performed as follows.

Specifically, as illustrated in FIG. 8, the image signal corresponding to the image region R created to have an area larger than an area of the recording material S is subjected to the following calculation. That is, with regard to the image signal, in order to prevent the edges of the image from being chipped off, a right-side integrated image data amount IR and a left-side integrated image data amount IL, which respectively correspond to 10 pixels (for example, approximately 400 μm) from the both end portions of the recording material S, are respectively calculated for one sheet of recording material. Note that, FIG. 8 illustrates a length L1 of the recording material S in the recording material conveying direction B.

Figure 4:
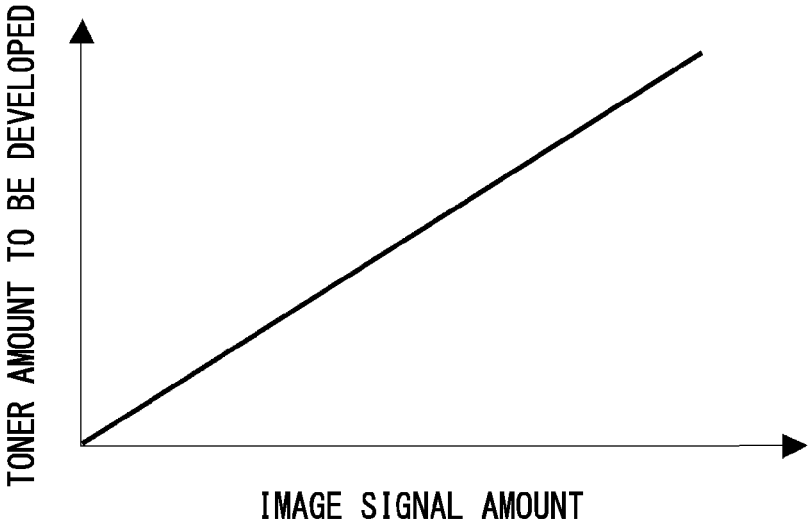
FIG. 4 is a graph schematically showing a correlation between an image signal amount and the toner amount to be developed.

The calculated right-side integrated image data amount IR and the calculated left-side integrated image data amount IL are stored in the backup RAM 54 (see FIG. 6) from the controller portion 51. Herein, an image signal amount as shown in FIG. 4 represents an exposure amount relating to respective pixels in exposure performed by the laser scanner units 12*a*, 12*b*, 12*c*, and 12*d*. The exposure includes an image signal amount of 4 bits (hexadecimal value) per pixel. As the image signal amount becomes larger, an exposure width becomes wider, and the bearing amount of toner in development (developed mass per area) becomes larger.

Accordingly, it is possible to assume that the exposure amount is substantially equal to the toner amount (see FIG. 4). In other words, as shown in FIG. 4, as the image signal amount of a horizontal axis increases, the toner amount to be developed of a vertical axis proportionately increases. Note that, FIG. 4 is a graph schematically showing a correlation between the image signal amount and the toner amount to be developed.

In the embodiment, in a case where the marginless print is designated, the image signal is created to have a larger area than the area of the recording material by 400 μm in four directions thereof, respectively, through a known enlargement processing step, which is not described here. This is a value set in order to avoid creating a margin on the grounds that, in consideration of conveying position control of the recording material and variations in size of the recording material, a relative position between the image information and the recording material changes at the secondary transfer portion 150 by approximately 300 μm at maximum.

Subsequently, in the step S4, an expanded image amount (image data amount) per unit of time relative to the recording material, that is, an expanded toner amount M is calculated. The expanded toner amount M is calculated from the following Expression 1 by using the right-side integrated image data amount IR and the left-side integrated image data amount IL at the both end portions which are obtained in the step S3, a conveying speed PS of the recording material per unit of time, the length L1 of the recording material S in the recording material conveying direction B, and a conveying interval L2 between a recording material S and a recording material S.

$$M(R \text{ or } L)=I(R \text{ or } L)\times PS/(L1+L2) \ldots \quad \text{(Expression 1)}$$

Subsequently, as in the following Expression 2, by comparing a right-side expanded toner amount MR with a left-side expanded toner amount ML, the larger one is set as a representative value P and stored in the backup RAM 54.

$$P=ML \text{ if } ML\geq MR$$

$$P=MR \text{ if } ML<MR \ldots \quad \text{(Expression 2)}$$

Subsequently, it is determined based on the set representative value P whether or not position displacement is necessary (S5). The necessity is determined based on whether or not the representative value P serving as the expanded toner amount is larger than 0.2 mg/sec. The value 0.2 mg/sec is a value set to allow latitude in the marking back in the embodiment in which a threshold (threshold value) of the toner amount for causing the marking back to occur, in other words, "c" of FIG. 3 is 0.4 mg/sec.

Then, when it is determined in the step S5 that the position displacement is not necessary, the procedure advances to the step S7 to start the image formation. On the other hand, when it is determined that the position displacement is necessary, a direction in which the recording material S is to be moved is first determined as a direction in which the expanded toner amount is smaller (a direction toward the smaller of the image data amounts corresponding to the both end portions of the recording material S). This is because the occurrence of the marking back can be minimized even in a case where, for example, the fur brush 71 is used beyond life thereof and the cleaning performance deteriorates to a lower level than expected.

Subsequently, in the step S6, a position changing portion performs setting of the movement of the recording material S and the image information, in other words, setting of displacing the position regulation plate 81 and the image information received from the controller portion 51 by 400 μm each. In other words, the controller portion 51 performs control of moving the transfer position and the formation position in the width direction in a state in which a moving direction and a moving amount of the recording material S by the moving mechanism 80 match respectively a moving direction and a moving amount of the formation position at which the image forming portions 10*a* to 10*d* form the toner images on the intermediate transfer belt 16. After that, in the step S7, the image formation is started.

Note that, when the marginless prints of the same image are continuously performed, the setting of performing the displacement of, for example, 400 μm every predetermined image formation count is performed.

In the case that the marginless prints of the same image are continuously performed, the moving direction and the moving amount are fixed, and hence, after repetitive movement, the recording material S reaches a position in which the recording material S cannot move any farther. When the recording material S reaches the position in which the recording material S cannot move any farther, irrespective of the determination of the toner amount, the movement is continued in a direction opposite to the moving direction followed so far. After that, when the recording material S reaches the farthest position on the opposite side, the movement is continued in the direction opposite to the moving direction followed so far. The above-mentioned operation is repeated.

After the image formation, it is determined whether or not a job has been completed, in other words, whether or not the subsequent print exists (S8). When it is determined that the subsequent print exists, the same operation as described above is repeated, and when it is determined that the subsequent print does not exist, the print operation is brought to an end (S9).

Note that, when the moving amount of the recording material becomes maximum, it is also possible to perform such control as to sufficiently clean the secondary transfer roller 35 with the fur brush 71 for a slight amount of time during which the conveyance of the subsequent recording material is stopped temporarily and then as to send the recording material into the secondary transfer cleaning device 7 again.

Figure 9:
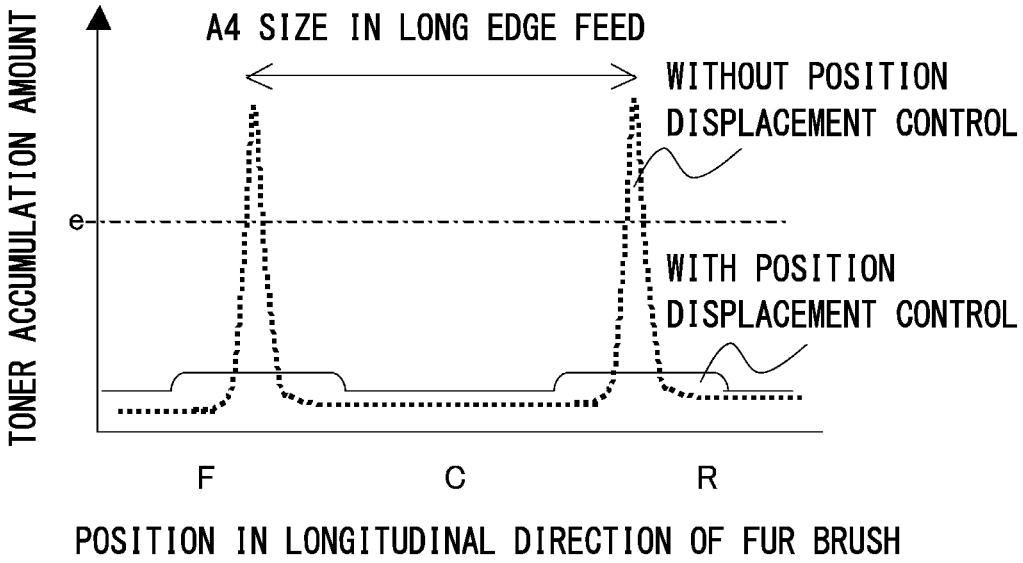
FIG. 9 is a graph showing an example of an effect of the first embodiment.

FIG. 9 is a graph showing results of the toner accumulation amount in the fur brush 71 which is obtained when 1,000 sheets of A4-size recording material are subjected to the marginless printing in long edge feed. In the graph, the horizontal axis indicates longitudinal position (position in the axial direction) of the fur brush 71 with "F" (front side), "C" (center), and "R" (rear side), and the vertical axis indicates the toner accumulation amount.

In the graph, there is a conspicuous difference between cases where the position displacement control according to the embodiment is performed and is not performed. That is, according to the graph, in the case where the position displacement control is not performed, as indicated by the dashed line, such large toner accumulation amounts as to exceed "e" on the vertical axis are confirmed in vicinities of the end portions of the recording material in the width direction in the longitudinal position of the fur brush 71. Accordingly, it is understood that, unless the position displacement control is executed, the toner remaining on the secondary transfer roller 35 without being completely removed by the fur brush 71 causes the marking back to occur on the recording material at a time of secondary transfer.

On the other hand, in the case where the position displacement control according to the embodiment is executed, as indicated by the solid line, such small toner accumulation amounts as to fall far below "e" on the vertical axis are confirmed in the vicinities of the end portions of the recording material in the width direction in the longitudinal positions of the fur brush 71. Accordingly, it is understood that, if the position displacement control is executed, the toner on the secondary transfer roller 35 is satisfactorily removed by the fur brush 71 and the toner accumulation amounts are dispersed in the vicinities of the end portions of the size of the recording material, which can effectively avoid the occurrence of the marking back on the recording material at the time of the secondary transfer.

According to the embodiment described above, the movement of the recording material performed by the position regulation plate 81 and the movement of the image information are controlled based on the determination result of the toner amount expanded from the recording material to the secondary transfer roller 35, to thereby cause no marking back to occur even if the marginless image is continuously printed on a large number of sheets. In this manner, in the case where the marginless print mode is selected, the print is performed while displacing the position of the recording material in the width direction orthogonal to the conveying direction by an amount equal to or smaller than the size of the recording material. This enables continuous marginless prints to be executed without causing the marking back to occur on the recording materials due to the toner expanded from the recording material.

In addition, the controller portion 51 moves the above-mentioned transfer position and the above-mentioned formation positions in the width direction in the state in which the moving direction and the moving amount of the recording material by the moving mechanism 80 match respectively the moving direction and the moving amount of the formation positions at which the image forming portions 10*a* to 10*d* form the toner images on the intermediate transfer belt 16. This can realize control for avoiding the occurrence of the marking back with extreme stability.

Further, the controller portion 51 calculates the expanded toner amount per unit of time based on the calculated image data amount, and depending on the expanded toner amount, changes the moving amount of the recording material by the moving mechanism 80 and the moving amount of the formation position of the image forming portions 10*a* to 10*d*. With this operation, in a case where the toner adhering to the secondary transfer roller 35 is attracted and collected by the fur brush 71, when there is a large amount of toner carried by the intermediate transfer belt 16 to reach, it is possible to control the recording material S to displace to a relatively large extent to thereby further improve the suppression of the marking back.

Note that, in the embodiment, the intermediate transfer belt 16 is used to indirectly form an image on the recording material, but instead thereof, the present invention can be applied to an image forming apparatus configured to directly form an image on the recording material by using a photosensitive drum. In that case, the photosensitive drum constitutes the image bearing member, and the toner image forming unit is constituted by the charging device, the exposure device, and the developing device, which are provided around the photosensitive drum.

(Second Embodiment)

Figure 10:
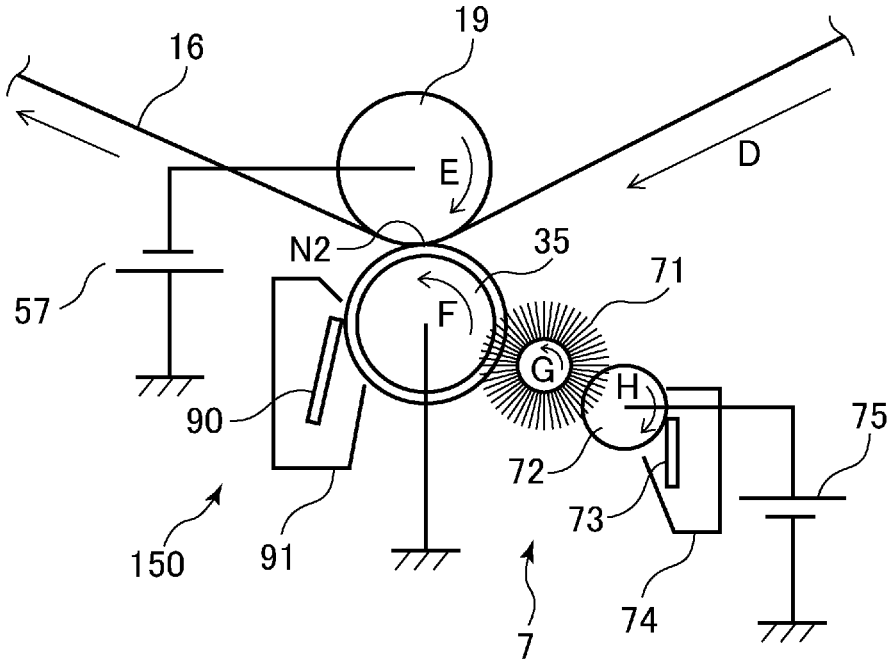
FIG. 10 is a structural diagram schematically illustrating a secondary transfer cleaning device according to a second embodiment of the present invention.
Figure 11:
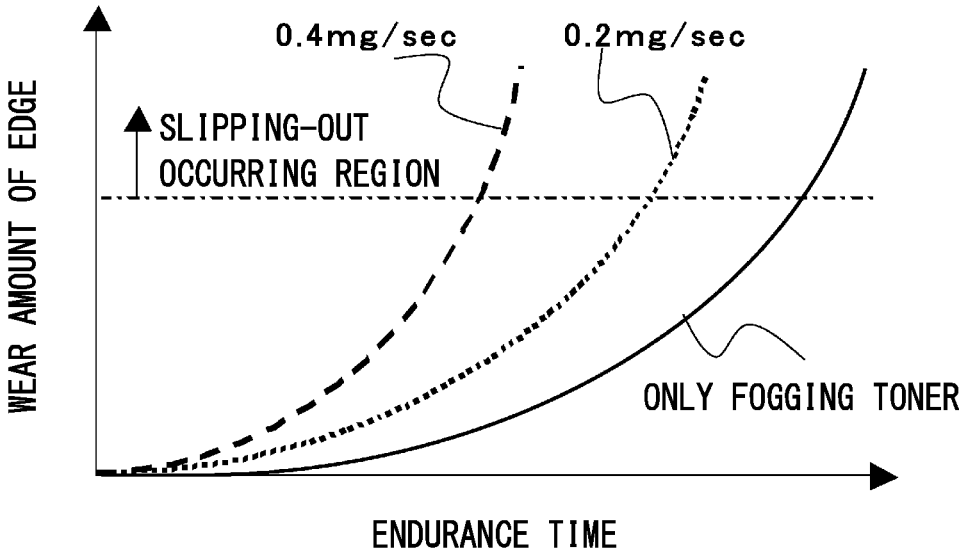
FIG. 11 is a graph showing a correlation between the toner amount and a wear amount of an edge of a cleaning blade according to the second embodiment.
Figure 12:
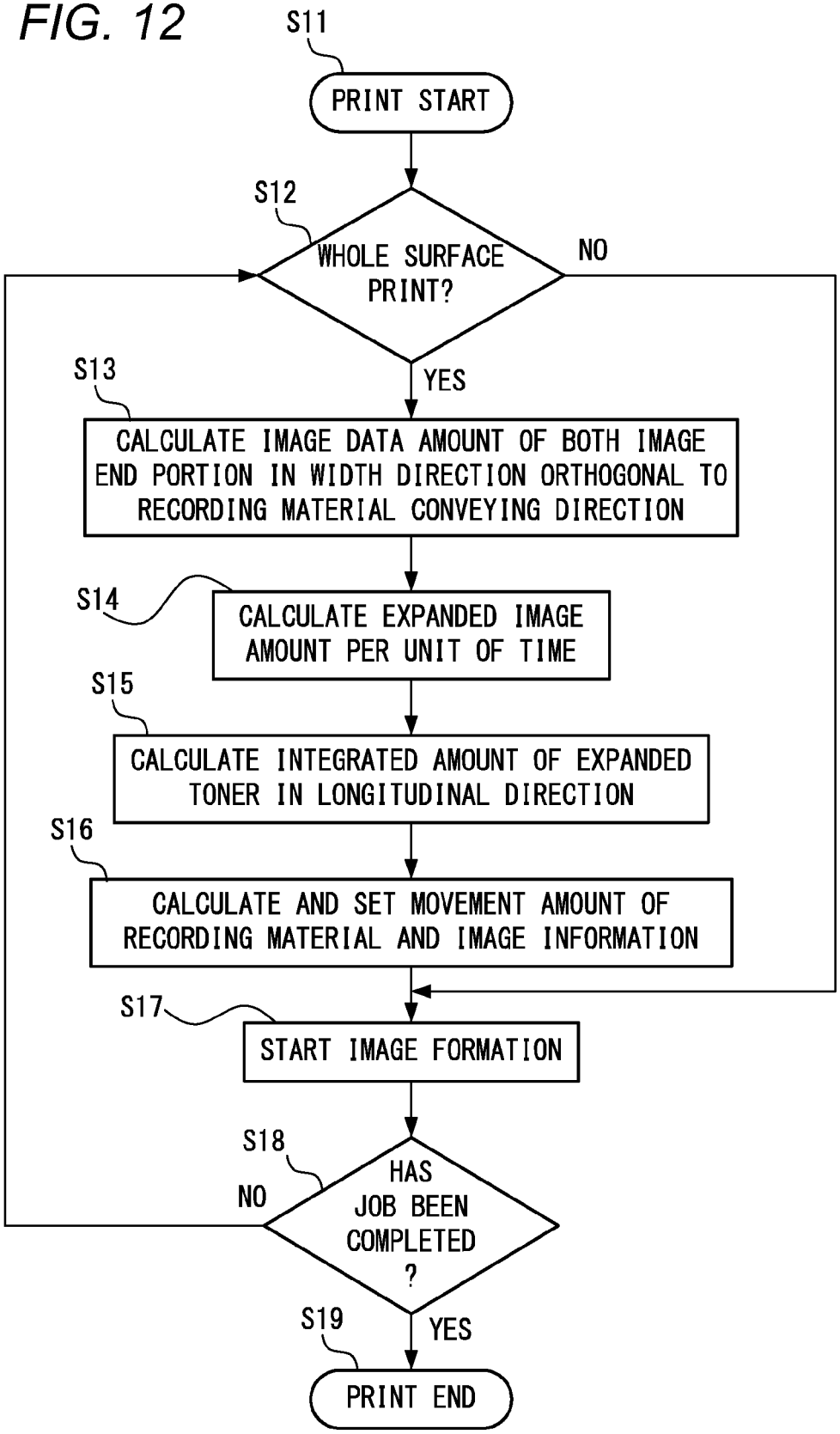
FIG. 12 is a flowchart of illustrating an operation at a time of printing according to the second embodiment.

Next, a second embodiment of the present invention will be described with reference to FIG. 10 to FIG. 12. In the embodiment, descriptions of the structures common to those described above in the first embodiment are omitted by assigning the same reference symbols thereto. Note that, FIG. 10 is a diagram illustrating a structure of the embodiment in which a cleaning blade 90 is added to a cleaning structure of the first embodiment, and FIG. 11 is a graph showing a correlation between the toner amount and a wear amount of the edge of the cleaning blade. FIG. 12 is a flowchart of illustrating an operation at a time of printing according to the second embodiment.

In the embodiment, as illustrated in FIG. 10, the cleaning blade 90 and a waste toner container 91 are disposed on a downstream side of the secondary transfer roller 35 in the recording material conveying path. The cleaning blade 90 is supported in a state that an edge portion of a distal end (upper end) is in sliding contact with a surface of the secondary transfer roller 35. The waste toner container 91 contains toner scraped off by the cleaning blade 90.

With a hybrid cleaning system in which the cleaning blade 90 is thus added to the fur brush 71, it is possible to more satisfactorily clean a locally large amount of toner that is hard to clean with the above-mentioned system using only the fur brush. Further, the existence of the cleaning blade 90 can greatly reduce the toner amount in the fur brush 71, and the fur brush 71 can function satisfactorily even if the cleaning performance is lowered. As a result, it is possible to prolong the life of the fur brush 71.

In this case, as described above, the cleaning blade 90 is brought into abutment with an upstream portion of the fur brush 71 with reference to the secondary transfer roller 35 in a counter direction. The cleaning blade 90 can be formed of urethane having, for example, a Wallace hardness value of 95°, a free length of 8 mm, and a thickness of 2 mm, and can be set to have an abutment angle of 15° and a linear pressure of 15 gf/cm. In this case, a width of an abutment nip is 5 μm.

The toner scraped off by the cleaning blade 90 drops into the waste toner container 91 so as to be collected. Note that, the above-mentioned Wallace hardness is measured by using a Wallace hardness tester (model: H12) (manufactured by H. W. Wallace & Co., Ltd.) as a measuring device based on an M test (micro test) of an International Rubber Hardness Degrees (IRHD). Measurement conditions therefor are 25° C./50% RH.

In the case of performing the marginless print with this structure, it is necessary to perform a control different from the first embodiment. This is because, as a cause of the marking back, the toner slips out due to wear caused by local concentration of the toner on the edge portion in the case of the cleaning blade 90, compared with the case where the marking back is determined based on the toner accumulation amount of the fur brush 71 when the cleaning structure uses only the fur brush 71.

Now, a correlation between the toner amount with respect to the cleaning blade 90 and the wear amount of the edge will be described with reference to FIG. 11.

In FIG. 11, the horizontal axis indicates an endurance time of the cleaning blade 90, and the vertical axis indicates the wear amount of the edge. In a graph of FIG. 11, the long dashed line indicates a case where the toner amount per unit of time with respect to the secondary transfer cleaning device 7 is 0.4 mg/sec, the short dashed line indicates a case where the toner amount is 0.2 mg/sec, and the solid line indicates a case of only the fogging toner. Further, the alternate long and short dash line indicates a slipping-out occurring region in which the toner slips out of an edge of the cleaning blade 90.

According to the graph, in the case of 0.4 mg/sec, the wear amount of the edge becomes large to generate the slipping-out occurring region at an early stage of the endurance time. In the case of 0.2 mg/sec, the wear amount of the edge becomes large to generate the slipping-out occurring region at a later stage of the endurance time than the case of 0.4 mg/sec. In the case of only the fogging toner, the wear amount of the edge becomes large to generate the slipping-out occurring region at a stage later than those cases. From those facts, it is understood that as the toner amount per unit of time becomes larger, the life until the toner slips out of the edge deteriorates more considerably. In other words, in order to maintain the cleaning performance as long as possible, it is important to prevent the local concentration of the toner.

Now, a flow of the control according to the embodiment will be described with reference to a flowchart of FIG. 12. That is, when the print information is sent to start printing (S11), the controller portion 51 (see FIG. 1 and FIG. 6) determines whether the print is a marginless print (whole surface print) or a print with a margin (S12). When the print with a margin is determined, it is recognized that the position displacement control is unnecessary, and an image formation is started (S17).

On the other hand, when the marginless print is determined in the step S12, in the same manner as described above, the image data amounts of both end portions of an image in the width direction orthogonal to the recording material conveying direction is calculated (S13). Then, in the step S14, in the same manner as described above, the expanded image amount (image data amount) per unit of time from the recording material, in other words, the expanded toner amount M is calculated.

Subsequently, in the step S15, an integrated amount of expanded toner in a longitudinal direction of the recording material S is calculated, in other words, the integrated amount of toner which has reached the cleaning blade 90 in the past is calculated. The calculation is performed every 10 pixels (for example, approximately 400 μm) from an image writing start reference position over a width of 323 mm and the result is stored in the backup RAM 54. The integrated amount is reset at a time of replacing the cleaning blade 90.

In addition, the above-mentioned data is used to perform such setting that the recording material S and the image position are to reach a place in which the integrated amount of the toner is smallest within a region which allows image formation (S16), and then the image formation is started (S17). After the image formation, it is determined whether or not the job has been completed, in other words, whether or not the subsequent print exists (S18). When it is determined that the subsequent print exists, the same operation as described above is repeated, and when it is determined that the subsequent print does not exist, the print operation is brought to an end (S19).

In the embodiment, the controller portion (control portion) 51 integrates the toner amount corresponding to the both end portions of the recording material based on the calculated image data amount, and controls the moving mechanism 80 and the image forming portions (position changing portion) 10*a* to 10*d* so as to move the above-mentioned transfer position and the formation position toward the smaller of the integrated toner amounts of the both end portions of the recording material. Then, by performing the printing on the recording material while displacing the position by an amount equal to or smaller than the size of the recording material in the width direction when the marginless print mode is selected, it is possible to execute the continuous marginless prints (execution portion) without causing the marking back to occur on the recording material due to the toner expanded from the recording material. In addition, the control for avoiding the occurrence of the marking back can be realized with extreme stability.

In the embodiment described above, in the system configured to cleaning the secondary transfer roller 35 with the cleaning blade 90, the movement of the recording material and the control of the image position are performed in order to prevent the local concentration of the toner in the longitudinal direction of the cleaning blade 90. Accordingly, it is possible to maintain the life of the cleaning blade 90 as long as possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-258142, filed Nov. 25, 2011, which is hereby incorporated by reference herein in its entirety.

What is claimed is:

1. An image forming apparatus, comprising:

a movable image bearing member;

a toner image forming portion configured to form a toner image on the image bearing member according to image data;

a transfer member configured to form a transfer portion by being pressed against the image bearing member, and transfer the toner image on the image bearing member to a recording material at the transfer portion;

a position changing portion configured to change a position of the toner image to be formed on the image bearing member in a width direction orthogonal to a moving direction of the image bearing member and a position in the width direction of the recording material to be conveyed to the transfer portion;

a cleaning member configured to clean toner adhering to the transfer member;

an execution portion configured to execute a marginless print mode of forming the toner image on the recording material without providing a margin by forming the toner image extending from a first region of the image bearing member corresponding to a position outside one end portion of the recording material in the width direction to a second region of the image bearing member corresponding to a position outside the other end portion of the recording material in the width direction; and a control portion configured to control the position changing portion, in a case where the execution portion continuously executes the marginless print mode, to change both the position of the toner image and the position of the recording material in the width direction to be used for performing subsequent image formation toward the first region, an integrated value of an image data amount in the first region being smaller than an integrated value of an image data amount in the second region with respect to the toner image obtained in image formation before the subsequent image formation, so that a change amount of the position of the toner image becomes the same as a change amount of the position of the recording material.

2. An image forming apparatus according to claim 1, wherein the control portion controls the position changing portion to change the position of the toner image and the position of the recording material every predetermined image formation count.

3. An image forming apparatus according to claim 1, wherein the image data amount comprises the integrated value of the image data amount of the toner image formed in the marginless print mode.

4. An image forming apparatus according to claim 1, wherein the control portion controls the position changing portion so that the change amount reaches a value corresponding to the image data amount of the second region.

5. An image forming apparatus according to claim 1, wherein the control portion controls the position changing portion so that the change amount reaches zero when the image data amount of the second region is smaller than a predetermined amount.

6. An image forming apparatus according to claim 1, wherein the image bearing member has change limit positions, in which at least one of the position of the toner image and the position of the recording material cannot be changed further toward outer sides, in an end portion on a side of the first region and an end portion on a side of the second region in the width direction, respectively, and the control portion controls, after the at least one of the position of the toner image and the position of the recording material reaches the change limit position on the side of the first region, the position changing portion to change the position of the toner image and the position of the recording material toward the second region irrespective of the image data amounts of the toner image in the first region and the second region.

* * * * *